United States Patent [19]

Kimble

[11] 4,390,564

[45] Jun. 28, 1983

[54] PROCESS AND APPARATUS FOR FINISHING DOORS

[76] Inventor: Alvin J. Kimble, 5001 Rainier Ave., Tumwater, Wash. 98501

[21] Appl. No.: 294,774

[22] Filed: Aug. 20, 1981

[51] Int. Cl.[3] ..... B05D 1/02; B05D 3/06

[52] U.S. Cl. ..... 427/35; 118/58; 118/72; 118/323; 118/324; 118/326; 118/642; 118/643; 427/55; 427/379; 427/401; 427/402; 427/424

[58] Field of Search ..... 118/58, 72, 323, 324, 118/326, 642, 643; 427/325, 401, 327, 379, 424, 402, 55, 35, 355

[56] References Cited

U.S. PATENT DOCUMENTS 4,096,300 6/1978 William et al. ..... 118/72 X

*Primary Examiner*—Michael R. Lusignan

*Attorney, Agent, or Firm*—Seed, Berry, Vernon & Baynham

[57] ABSTRACT

A process and apparatus allows continuous or semicontinuous finishing of doors. The doors are fed to the finishing machine and are conveyed through a series of finishing stages. Sanding, staining, drying, lacquering (finish-coating), drying, cooling, and buffing in the machine leave a completely finished door to exit the machine. Automatic stacking of finished doors is easily accommodated. Water-reducible stains and lacquers are readily used in this novel process and apparatus to reduce health and fire hazards. The process greatly reduces the time required to finish a door.

35 Claims, 8 Drawing Figures

PROCESS AND APPARATUS FOR FINISHING DOORS

DESCRIPTION

Technical Field

This invention relates to a semi-continuous or continuous process for finishing doors and to a finishing machine to accomplish the process.

Background Art

Customarily, doors and other wooden pieces of trim are finished by hand by applying solvent-based stain and lacquer. Because the solvent-based material presents a substantial fire and health hazard, there are tremendous difficulties in establishing a semi-continuous process to complete this finishing. The materials require special handling, which substantially increases the cost of finishing.

Ordinarily, the finishing of a door, for example, will be done by suspending the door in a finishing room, hand-sanding the door, and hand-finishing the faces and edges of the door. The finishing process is labor-intensive.

At least one semi-continuous process for finishing doors has been developed. This process, however, complicates the assembly of doors because it requires the finishing of each door panel in a roll coater prior to assembly of the door. That is, the door panels, being thin veneers, are initially finished by passing them through customary roll-coating machines. The finished door panels are then assembled into the door. While this method is less labor-intensive than the ordinary hand-finishing process, the method requires the door manufacturers do the finishing rather than have independent finishing companies which could otherwise finish the assembled doors.

DISCLOSURE OF INVENTION

In a semi-continuous or continuous process for finishing doors, a plurality of doors are fed to a finishing machine. The machine conveys each door serially along the machine while performing the finishing steps of staining the faces and edges of the door, drying the stain at least partially, finish-coating the faces and edges of the stained door, and drying the finished coating on the door prior to stacking the finished doors which exit the machine. Of course, additional steps of finishing may be included in the machine, such as sanding of the doors prior to staining and buffing of the doors prior to stacking. Preferably, a water-reducible stain and lacquer are used to avoid the problems generally caused by oil-based stains and lacquers. With a water-reducible paint, there are less health hazards and a highly reduced fire hazard.

An apparatus to finish doors in a continuous or a semi-continuous process has means for feeding doors serially to a number of finishing stages where the doors are stained, dried, finish-coated, and dried prior to stacking. A single machine may include all of the steps, or, preferably, each step is an independent module which may be placed within the machine. Modular construction allows easier movement of the machine about the shop and allows for replacement of worn modules without long shutdown of the entire finishing machine and process.

The process and apparatus of this invention greatly reduce the cost of finishing a door and result in an anticipated cost of about one dollar per door to completely finish the door. Because a non-flammable, water-reducible stain and lacquer are used, insurance costs are greatly reduced for the plant. Furthermore, the number of restrictions placed on the plant because of fire and health regulations is greatly reduced. Finally, the water-reducible stain and lacquer may be recycled and better used, thereby avoiding the customary thirty-percent loss of solvent-based paint. Approximately one thousand doors may be finished in each eight-hour working shift by only two or three people.

BEST MODE FOR CARRYING OUT THE INVENTION

To finish a door completely in a semi-continuous or continuous process, the apparatus of this invention employs nine finishing stages. Doors are fed serially through the finishing stages. First, the faces of the doors are sanded to remove any roughness and to prepare the wood for staining. Second, the faces and edges of the doors are stained. Third, the stain is at least partially dried. Fourth, a finish coating, such as a lacquer, is applied to the stained doors along their faces and edges. Fifth, the finish coating is dried. Sixth, the finished doors are cooled, and, seventh, the doors are buffed along their faces. Eighth, the doors are stacked on a pallet at the end of the machine, and, ninth, the edges of the doors are buffed. Using the machine of this invention, approximately one thousand doors may be finished in an eight-hour working shift, while greatly reducing the labor intensity normally required to finish doors. It is anticipated that it will cost about one dollar to finish a door with the machine of this invention. Because the machine capitalizes on the use of water-reducible stains and lacquers, there are far less restrictions in using this machine than with presently available semi-continuous processes to finish doors with solvent-based products.

Figure 1:
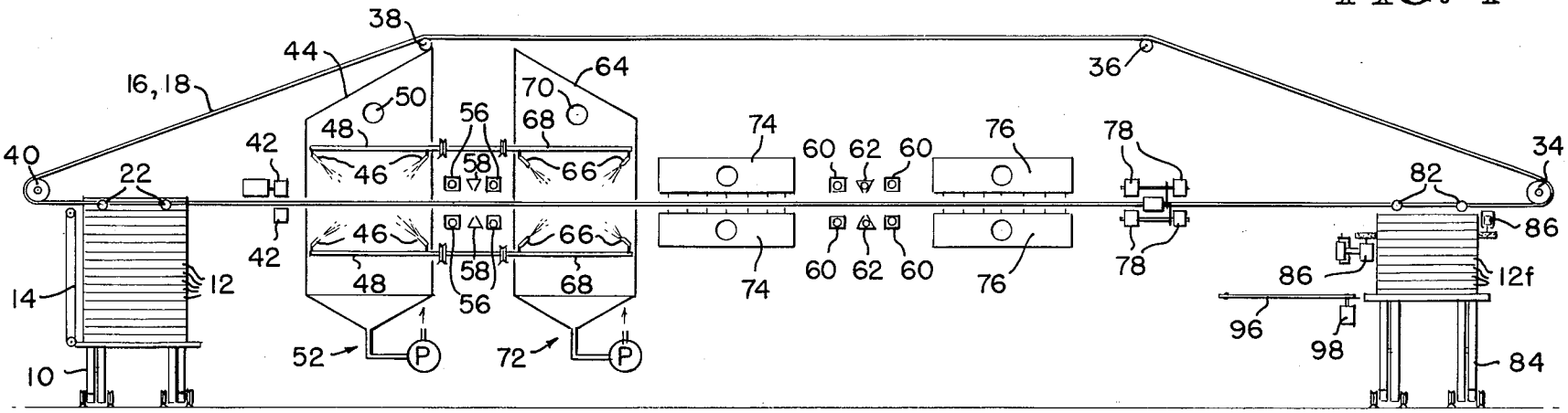
FIG. 1 is a partially schematic side elevation of the finishing machine of this invention.
Figure 3:
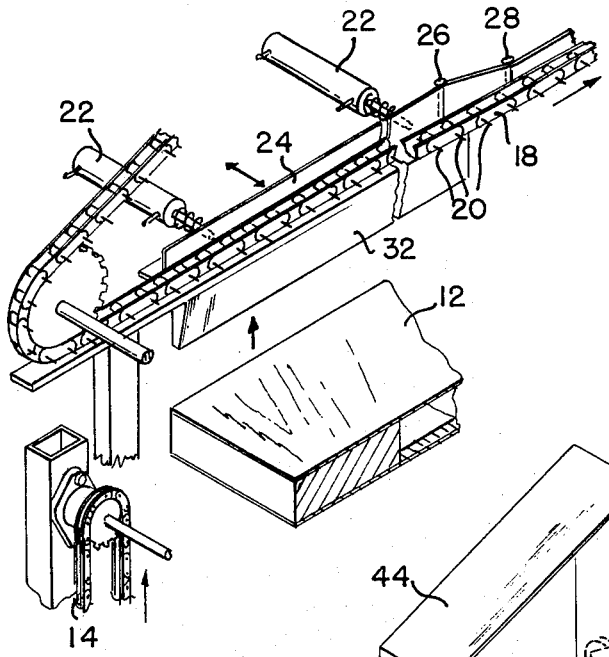
FIG. 3 is a detailed isometric of the conveying means at the top of the feeder.
Figure 4:
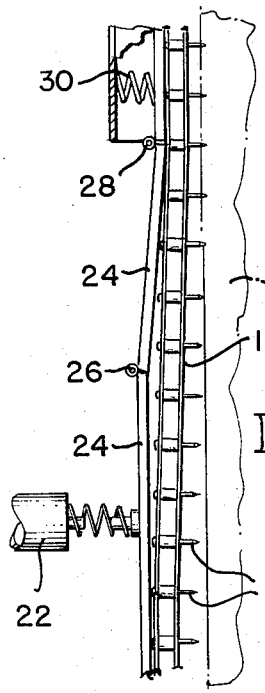
FIG. 4 is a top plan detail of the conveyor means.

As shown in FIG. 1, a pallet 10 of doors 12 is rolled into a means for feeding doors serially into the finishing machine of this invention. As the doors 12 are raised by the lifting means 14, a limit switch (not shown) is engaged to drive two endless conveying belts 16 and 18 inwardly to engage the door 12 on its ends with a plurality of pins 20 or, preferably, pads which frictionally hold the door in a substantially horizontal position. As best seen in FIGS. 3 and 4, the endless belts 16 and 18 are driven inwardly by hydraulic cylinders 22. Preferably, the cylinder pistons are spring-loaded so that the pistons will retract when the pressure of the cylinder is released. The pistons are connected to metal sheets 24 which are substantially aligned with the endless belts 16 and 18. Hinges 26 and 28 allow the sheets 24 to flex outwardly slightly to allow feeding of a door to the machine. When the cylinders 22 are engaged, the pistons push against the sheets 24, which in turn press against the endless belts 16 and 18 to drive the pins 20 into the ends of the door 12. Pressure on the pins 20 is maintained against the doors 12 by spring-loaded means 30 which run adjacent to the belts along the finishing stages of the machine. To ensure that the doors 12 are in proper position to be engaged by the endless belts 16 and 18, a vertical guide ramp 32 extends downwardly from the belts 16 and 18 to wedge the doors into the proper position. Once the doors 12 are engaged by the endless belts 16 and 18, the lifting means lowers the stack of doors 12 slightly so that as the belt moves from left to right in FIG. 1, the top door 12, which is engaged by the belts 16 and 18, is removed from the stack and proceeds into the first finishing station.

The endless belts 16 and 18 extend substantially parallel to one another approximately 79 –80 inches apart. Because doors customarily come in 79- and 80-inch lengths, this spacing allows easy adjustment and modification of the machine to handle both types of doors. As shown in FIG. 1, the belt 16 extends substantially horizontally through the finishing stages, around a drive sheave 34, upwardly over the machine, engaging two sheaves 36 and 38, and finally downwardly at the front of the machine to engage a second drive sheave 40.

Sanding belts 42 are positioned above and below the plane defined by the belts 16 and 18. These sanding belts 42 engage the doors 12 as they pass underneath the belts. Sanding of both faces of the doors 12 occurs substantially simultaneously. Because the doors 12 are nearly finish-sanded in their construction, the sanding belts need only accomplish fine sanding to prepare the doors for staining and lacquering.

Figure 5:
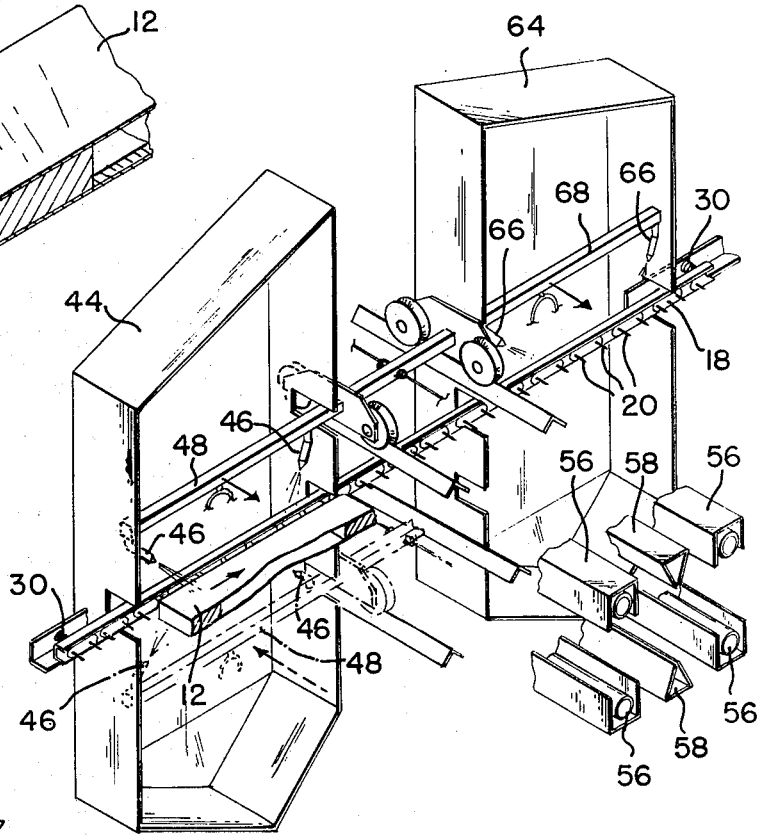
FIG. 5 is a schematic detail of the spray booths used in the finishing machine of this invention.

After sanding, the doors 12 enter a spring booth 44 where a viscous, water-reducible stain is airlessly sprayed on the faces and edges of the doors 12 by suitable means. Preferably, the stain has approximately forty percent solids. Therefore, because the spraying is done essentially on planar surfaces, a very controllable finish is obtainable. As best shown in FIG. 5, four spray nozzles 46 are supported on frame members 48 and are movable along the length of the doors 12 as the doors are through the spray booth 44 to spray stain upon the faces and edges of the doors 12. Preferably, the spray nozzles 46 are staggered in their confirmation in the spray booth 44. That is, while the upper nozzles begin at the upper left-hand end of the doors 12, the lower spray nozzles begin at the lower right end and the nozzles criss-cross one another as they move across the doors. The spray booth 44 also has a filter 50 connected to an air line 52 and pump 54 to knock out excess stain from the confined air of the booth 44. The bottom of the booth 44 has suitable means 52 for recycling excess stain which is sprayed from the nozzles 46. While in the common practice of finishing a door up to thirty percent of the solvent-based paint is lost during spraying, the spray booth 44 of this invention allows for almost complete recovery of paint which does not remain on the door. Substantial savings may be made because the paint can be recycled.

Figure 2:
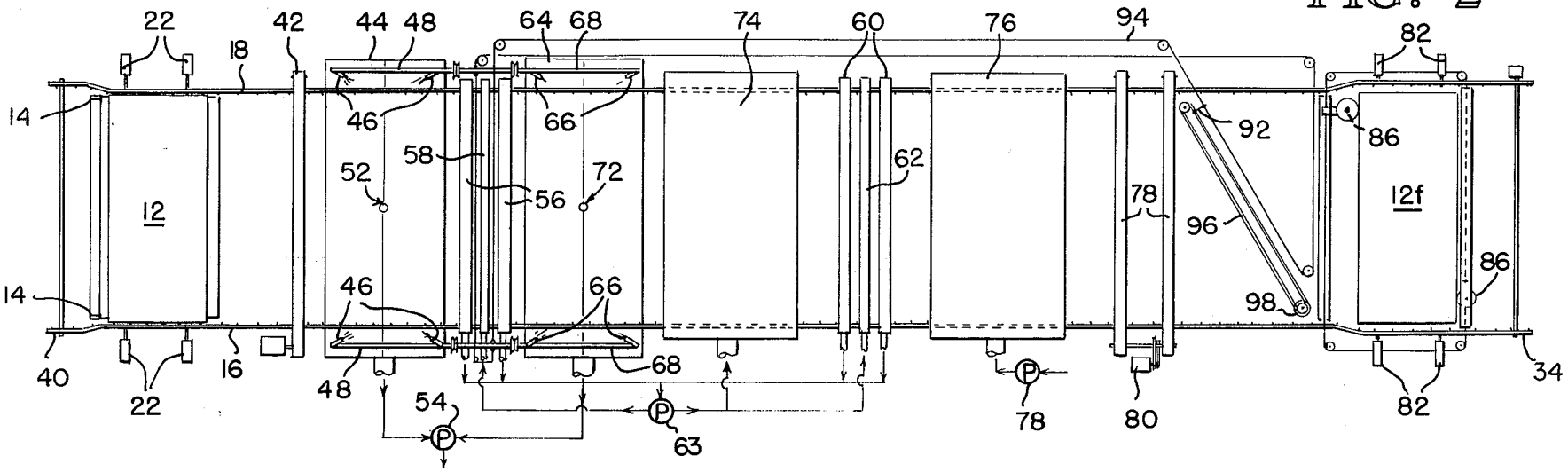
FIG. 2 is a partially schematic top plan view of the finishing machine of FIG. 1.

Exiting the spray booth 44, the doors 12 proceed into a drying section where two infrared burners 56 partially dry the stained doors. As with the sanding belts 42, the infrared burners 56 are positioned above and below the plane on which the doors travel. Sandwiched between the infrared burners 56 are air knife blowers 58 which blow evenly over the surface between about 4000–6000 scfm face velocity of heated air upon the entire length of the doors. Air knives are preferred because they supply the necessary volume of air uniformly over the entire surface of the doors. Preferably, the heated air is at a temperature of about 120° F., although the air may be anywhere between ambient temperature and about 180° F. As best shown in FIG. 2, the heated air is supplied by collecting air from around the infrared burners 56 with a pump 63, and distributing the heated air back to the air knives 58. Because the doors pass by the infrared burners 56 and air knives 58 at a rate of between about 6–8 feet per minute (preferably at a rate of between 16–20 feet per minute), this initial drying stage probably only partially dries the stain that has been applied to the door. Partial drying, however, is all that is required before the doors 12 pass into the next finishing stage.

Figure 6:
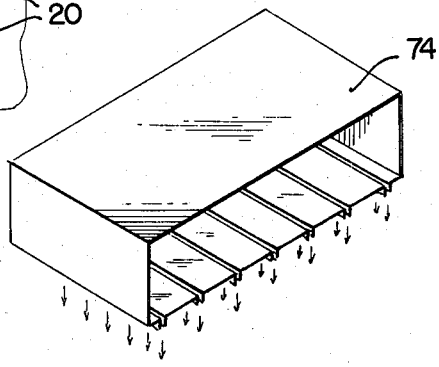
FIG. 6 is a sectional schematic of a drier of this invention.

The infrared burners 56 and air knife blowers 58 can be replaced with a convection dryer of the type shown in FIG. 6. About 1000–2000 scfm are supplied to the doors at about 120° F. with the dryer. A convection dryer is preferred for this first drying stage.

After partial drying, the doors 12 pass into the second finishing stage and spray booth 64. The spray booth 64 is substantially similar to spray booth 44, previously described. Four spray nozzles 66 on support arms 68 spray a water-reducible lacquer having approximately thirty percent solids with airless spraying onto the faces and edges of the doors. As with the nozzles of spray booth 44, the conventional spray nozzles 66 of spray booth 64 pass across the length of the doors optimally at a rate of three strokes per second. Because the doors travel only between about 6–8 feet per minute, however, the stroke may be slowed, preferably to about one stroke for every three seconds at this rate.

A filter 70 is positioned in the spray booth 64 and is connected to pump 54 to knock out excess lacquer sprayed in booth 64. Suitable collection means 72 are positioned at the bottom of the spray booth 64 to collect excess lacquer which is sprayed from the nozzles 66. As with the excess stain sprayed in spray booth 44, this excess lacquer may be recycled at substantial savings to the finisher.

Exiting the second spray booth 64, the doors enter a drying stage. First, air is blown over the surface of the doors by an air blower 74, which, as with the other parts of this invention, is positioned above and below the plane on which the doors travel. A detailed cross-section of the air blower 74 is shown in FIG. 6. To dry the doors 12 before stacking, the air blower 74 supplies between about 1000–8000 scfm of heated air having a temperature between ambient and about 180° F. As with the air supplied to air knives 58 and 62, the heated air for the air blower 74 is supplied by collecting air from the infrared burners 58 and 62 with pump 63. Alternatively, heated air is supplied to the air blower 374 by pumping air past a gas burner. Exiting the air blower 74, additional drying is provided to the doors by a combination of infrared burners 60 and air knife blowers 62, similar in construction to those of the partial drying section between the spray booths. This additional drying stage ensures that the finish coating is completely dried.

Exiting this second drying stage, the doors 12 next pass into a cooling stage where air blowers 76, positioned above and below the plane on which the doors travel, blow ambient air over the heated doors. A pump 78 supplies between about 1000–8000 cubic feet minute of air through knives over the entire surface of the doors. This cooling air further dries the stain and lacquer, and allows the doors to be buffed and stacked almost immediately. In some circumstances, additional cooling may not be required.

Figure 7:
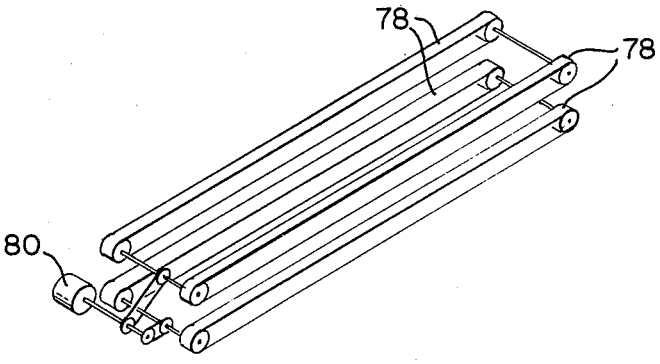
FIG. 7 is a schematic of the buffing belts and drive means of this invention.
Figure 8:
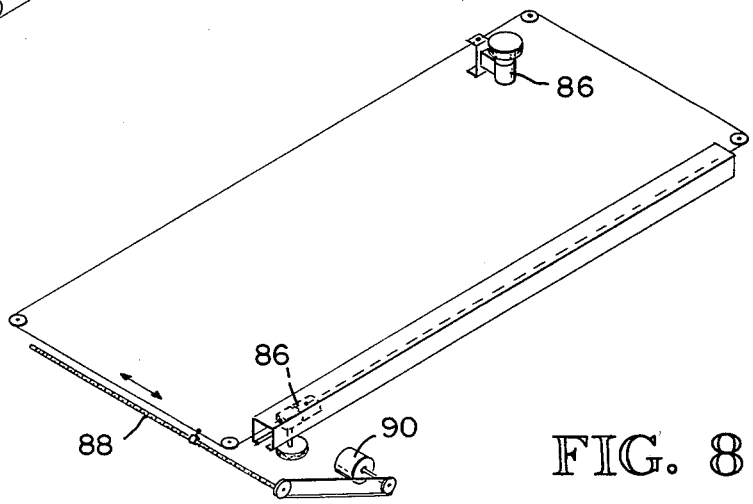
FIG. 8 is a schematic of the drive means for the edge buffers of this invention.

Exiting the cooling stage, the doors 12 next pass into a burnishing or buffing stage. Here, a very fine sandpaper or a carpet material contacts the top and bottom planar surfaces of the door to buff and polish the finish coating. As shown in FIG. 7, the buffing belts 78 are coordinated by suitable means 80 to engage the planar surfaces of the doors 12 substantially simultaneously and to be driven together.

Exiting the top and bottom buffing stage, the doors 12 enter the stacking means. The stacking means is substantially similar to the feeding means and operates in analogously the reverse operation. A limit switch (not shown) is engaged to retract the pistons of hydraulic cylinders 82 to move the endless belts 16 and 18 outwardly slightly so that the pins 20 disengage from the ends of the doors 12*f*. A pallet 84, having suitable lift means associated with it, maintains the height of the finished doors 12*f* which are dropped from the endless belts 16 and 18. Once in the stack, the finished doors 12*f* have their edges buffed by edge buffers 86. The width of the edge buffers 86 is preset with a worm gear 88 extending along an edge of the frame of the finishing machine. A suitable motor 90 drives the buffers 86 along the edges to finish polishing them.

In the operation of the top and bottom buffing belts, preferably a limit switch is activated which in turn activates a pneumatic cylinder to automatically sandwich the door between the belts prior to the activation of the motor which drives the belts. A pressure-sensitive regulator is associated with the pneumtic cylinders and motor to balance the pressure applied to the top and bottom belts so that the finish on both sides of the door is burnished to substantially the same smoothness and quality.

To drive the nozzles 46 and 66 substantially simultaneously, a continuous chain moves the arms 48 and 68 together. A rigid link 92 connects this common chain 94 to an endless belt 96 which rotates under the action of a single motor 98. Thus, coordination of the spray nozzles is easily accomplished with consequent reduction in the power necessary to operate the machine.

Although shown and described as a unitary system having a single continuous, endless belt, the finishing machine of this invention may also be made in modular construction with each of the finishing stages as a separate unit. Preferably, the machine will be modular to allow more easy movement about the shop and to allow quick replacement of worn or defective pieces in the process. If modular, the entire machine need not be shut down due to the failure of a single piece of the machine, but, instead, the defective piece may be removed and finishing may proceed. If made in a modular design, each stage may have its own drive means which have consequent coordination with modules preceding and following the specific module in question. Because little problems result from the endless belts 16 and 18, however, it is possible that each stage will be built modularly on its own frame and be threaded with a unitary, endless belt system substantially as described. Also, preferably, means will be provided so that the pallet entering the feed means of the machine is drawn under the machine as the doors proceed through the finishing stages to catch the finished doors as they exit the machine. In this way, labor intensity will be further reduced because no longer will one person be needed to feed the doors to the machine while a second person collects doors on a second pallet as they exit the machine.

Because water-reducible stains and lacquers are employed in the spray booths of this invention, it is possible to use infrared radiant burners which employ flames. In this way, fuel costs are substantially decreased. Approximately, six dollars per hour is the anticipated cost for natural gas supplied to the infrared burners. If propane is employed rather than natural gas, the fuel costs should be about twelve dollars per hour. Preferably, the infrared burners supply approximately 15,000 Btus/foot-hour to the doors for drying.

The finishing machine of this invention is a substantial improvement over the common roll-coater which allows automatic finishing of paneling and other thin veneers. First, the finishing machine of this invention allows for the complete finishing of preconstructed doors of a substantial thickness. Roll-coaters are limited to thin veneers because the product to be finished must contact the rolls over their curved surfaces. Finally, with the finishing machine of this invention, both the faces and edges of the doors may be finished in one pass through the machine. Already assembled doors may be easily prepared for home use in a semi-continuous or continuous process.

I claim:

1. A semi-continuous or continuous process for finishing a door in a finishing machine, comprising the steps of:

(a) feeding a plurality of doors to a finishing machine;
(b) conveying each door serially along the machine by holding each door with pressure exerted on the ends of the door while performing the substeps of:
  (i) staining the faces and edges of each door in a single staining operation;
  (ii) at least partially drying each door;
  (iii) finish-coating the faces and edges of each door in a single finish-coating operation; and
  (iv) drying the finish coating; and
(c) stacking the finished doors which exit from the machine by removing the pressure exerted on the ends.

2. The process of claim 1 wherein the step of conveying further includes the substep of sanding the faces of the doors prior to staining.

3. The process of claim 2 wherein the sanding of both faces occurs substantially simultaneously.

4. The process of claim 1 wherein the step of conveying further includes the substep of buffing the faces prior to stacking.

5. The process of claim 1 wherein the step of conveying further includes the substep of cooling the doors prior to stacking.

6. The process of claim 5 wherein the substep of cooling includes blowing ambient air around the doors.

7. The process of claim 1 wherein the substep of staining includes spraying stain on the doors.

8. The process of claim 7 wherein a water-reducible stain is sprayed substantially simultaneously on the faces of each door.

9. The process of claim 1 wherein the substep of finish-coating includes spraying lacquer on the doors.

10. The process of claim 9 wherein a water-reducible lacquer is sprayed on the faces of each door substantially simultaneously.

11. The process of claim 1 wherein both substeps of drying include blowing warm air around the doors.

12. The process of claim 1 or claim 11 wherein both substeps of drying include radiant heating of the faces of each door.

13. The process of claim 4 wherein the substep of buffing is further subdivided the steps of:

(a) buffing substantially simultaneously both faces of the door; and (b) buffing the edges of the door after the door is stacked.

14. A process for finishing a door in a finishing machine, comprising the steps of:

(a) feeding a plurality of doors to a finishing machine:

(b) conveying each door serially along the machine by holding each door with pressure exerted on the ends of the door while performing the substeps of:

(i) sanding the faces and edges of each door (ii) staining the faces and edges of each door in a single staining operation;

(iii) at least partially drying each door;

(iv) finish-coating the faces and edges of each door in a single finish-coating operation;

(v) drying the finish coating; and (vi) cooling each door; and (c) stacking the finished doors which exit from the machine.

15. The process of claim 14 wherein the substep of staining includes spraying a water-reducible stain on each door.

16. The process of claim 14 wherein the substep of finish-coating includes spraying a water-reducible lacquer on each door.

17. The process of claim 14 wherein the step of drying the finish coating includes (a) radiant heat drying and (b) convective heat drying from blowing air.

18. The process of claim 14, further including the substep of buffing the doors prior to stacking and during the conveying.

19. The process of claim 1 or claim 14 wherein the doors are conveyed with their face planes being substantially horizontal.

20. The process of claim 1 or claim 14 wherein the step of feeding includes the substeps of:

(i) rolling a pallet of stacked doors into the machine;

(ii) raising the stacked doors from the pallet; and (iii) grasping the top door along its ends.

21. The process of claim 20, further including the substeps of:

(i) lowering the stacked doors after the top door is grasped to reduce friction between the grasped door and the stack; and (ii) re-raising the stacked doors as the grasped door is conveyed into the finishing machine.

22. An apparatus to finish doors in a continuous or a semi-continuous process, comprising a finishing machine including:

(a) means for feeding doors serially to a number of finishing stages by conveying the doors with grasping means which contact each door only along the ends of each door;

(b) means for staining each door substantially simultaneously on its faces and edges;

(c) means for drying the stained door at least partially;

(d) means for finish-coating each stained door substantially simultaneously on its faces and edges;

(e) means for drying the finish coating; and (f) means for stacking the finished doors.

23. The apparatus of claim 22, further including means for sanding the faces of the doors prior to staining.

24. The apparatus of claim 23 wherein the means for sanding sands both faces substantially simultaneously.

25. The apparatus of claim 22, further including means for buffing the faces and edges of finished doors.

26. The apparatus of claim 22, further including means for cooling the doors prior to stacking.

27. An apparatus to finish doors in a continuous or a semi-continuous process, comprising a finishing machine including:

(a) means for feeding doors serially to a number of finishing stages by conveying the doors with grasping means which contact each door along the ends of each door;

(b) means for sanding both faces of each door prior to staining;

(c) means for staining the doors substantially simultaneously on their faces and edges;

(d) means for drying at least partially the stained doors;

(e) means for finish-coating each stained door substantially simultaneously on the faces and edges of the door;

(f) means for drying the finish coating;

(g) means for cooling the dried doors;

(h) means for buffing the cooled, finished doors; and (i) means for stacking the finished doors upon exit from the machine.

28. The apparatus of claim 22 or claim 27 wherein the stages are modular and wherein the means for feeding connects the modules into a finishing machine.

29. The apparatus of claim 22 or claim 27 wherein the means for feeding conveys the door substantially horizontally through the finishing stages.

30. The apparatus of claim 22 or claim 27 wherein the means for staining includes:

(i) means for spraying stain substantially simultaneously on the faces and edges of the door; and (ii) a spray housing to contain the spray of stain.

31. The apparatus of claim 30 wherein the means for staining further includes means for recycling stain collected in the spray housing.

32. The apparatus of claim 22 or claim 27 wherein the means for finish-coating includes:

(i) means for spraying lacquer substantially simultaneously on the faces and edges of the door movable along the door's length in a spray housing;

(ii) a spray housing to contain the spray of lacquer.

33. The apparatus of claim 32 wherein the means for finish-coating further includes means for recycling lacquer collected in the spray housing.

34. The apparatus of claim 22 or claim 27 wherein both means for drying include:

(i) means for blowing air around the doors (especially on their faces); and (ii) means for radiant heating of the doors to aid their drying.

35. An apparatus to finish doors in a continuous or a semi-continuous process, comprising a finishing machine including;

(a) means for feeding doors serially to a number of finishing stages by conveying the doors with grasping means which contact each door only along the ends of each door;

(b) means for sanding the faces of the doors prior to staining;

(c) means for staining each door substantially simultaneously on the faces and edges, including
  (i) a spray housing to contain a spray of stain;
  (ii) means for spraying stain substantially simultaneously on the faces and edges of each door; and
  (iii) means for recycling stain collected in the spray housing;

(d) means for drying at least partially the stained doors, including means for blowing air around the doors (especially on the faces);

(e) means for finish-coating each stained door substantially simultaneously on its faces and edges, including
  (i) a spray housing to contain a spray of lacquer;
  (ii) means for spraying lacquer substantially simultaneously on the faces and edges of each door; and
  (iii) means for recycling lacquer collected in the spray housing;

(f) means for drying the finish coating on the doors, including
  (i) means for blowing air around the doors (especially on their faces); and
  (ii) means for radiant heating of the doors to aid their drying;

(g) means for cooling the dried doors, including means for blowing air around the doors for convective cooling;

(h) means for buffing the cooled doors; and (i) means for stacking the finished doors upon exit from the machine.

* * * * *